United States Patent [19]

Lemelson

[11] Patent Number: 4,560,978

[45] **Date of Patent: * Dec. 24, 1985**

[54] COMMUNICATION SYSTEM AND METHOD

[76] Inventor: Jerome H. Lemelson, 85 Rector St., Metuchen, N.J. 08840

[ * ] Notice: The portion of the term of this patent subsequent to Jun. 19, 2001 has been disclaimed.

[21] Appl. No.: 622,109

[22] Filed: Jun. 19, 1984

Related U.S. Application Data

[62] Division of Ser. No. 110,542, Jan. 8, 1980, abandoned.

[51] Int. Cl.[4] ..... G08B 1/08; G08B 21/00

[52] U.S. Cl. ..... 340/539; 340/534; 340/531; 340/692; 381/51

[58] Field of Search ..... 340/539, 505, 506, 525, 340/531, 534, 692, 825.36, 825.69, 825.72, 286 R, 286 M, 293, 298, 345, 346, 350, 52 F, 524; 381/51, 53; 364/550; 179/5 R, 5 P; 455/53, 54, 67, 352, 353

[56] References Cited

U.S. PATENT DOCUMENTS

| | | | |
|---|---|---|---|
| 3,848,231 | 11/1974 | Wootton | 340/539 |
| 3,870,818 | 3/1975 | Barton et al. | 340/52 F |
| 3,914,692 | 10/1975 | Seaborn, Jr. | 340/539 |
| 3,925,763 | 12/1975 | Wadhwani et al. | 340/539 |
| 4,455,551 | 6/1984 | Lemelson | 340/539 |

*Primary Examiner*—Donnie L. Crosland

[57] ABSTRACT

A communication system for communicating information between one or more sensors and a remote location which may be fixed or portable wherein the information received is converted to synthetic speech so as to verbally indicate or warn a person or persons at or near the receiver as to the condition sensed or a condition which is developing at a known or indicated remote location as indicated by the output of one or more sensors. The system may also contain a fixed data receiving station and one or more portable units for receiving signals from such fixed station and/or remote sensors wherein the fixed station serves not only to relay the information to the portable receivers but also to process the information it receives. In a particular form of the invention, the fixed station includes a computer or circuits which process the data or signals received from the sensor or sensors and generates synthetic speech signals which are short wave transmitted to one or more satellite or portable stations and generate synthetic speech thereat warning or indicating to a person or persons at or near the satellite receiver or receivers of the condition sensed.

6 Claims, 4 Drawing Figures

COMMUNICATION SYSTEM AND METHOD

RELATED APPLICATIONS

This is a division of my copending application Ser. No. 110,542 filed Jan. 8, 1980 now abandoned and entitled Synthetic Speech Communication System and Method.

SUMMARY OF THE INVENTION

This invention relates to a system and method for communicating information between one or more sensors and one or more receivers or stations at which a person or persons may be located and warned of a condition which is remotely or locally sensed by electrical, electronic, fluidic or other sensing means operable to generate or effect the generation of signals indicative of such condition and to effect the transmission of such signals either directly or indirectly to a receiver and indicator. Synthetic speech synthesizing and generating means is provided either at a fixed receiver or one or more portable receivers for indicating by speech sounds a warning to personnel within hearing range of a speaker of the condition sensed.

In the supervising or surveillance of various conditions such as process variables, intrusion by persons or vehicles, structural vibrations, fluid leakage, fire, radiation, improper or unsafe machine operation or other variables by human beings, it is frequently desireable to indicate by sounds such as speech, a sudden change or approaching change in the condition sensed. Warning lights or displays, visible recordings on paper and often conventional sound generators may either improperly indicate, go unheeded or even confuse a person within range thereof.

The instant invention employs speech synthesizing means which is responsive either to signals generated by sensors or by computers or microprocessors receiving signals from one or more sensors. In a system where a plurality of condition sensors are employed, the signal output of each is accompanied by a specific code which is indicative of the sensor or its location and is transmitted either per se or with the sensor generated signal to a signal processor including a synthetic speech signal generator for generating synthetic speech signals indicative of the condition sensed and, in certant instances, the location of such condition in the form of synthetic speech on the output of a speaker. Where the sensor senses a variable condition and generates signals which vary as the condition sensed varies, such signals are processed to selectively generate synthetic speech signals for particularly indicating the condition sensed and varying in such indication as the condition varies.

Accordingly it is a primary object of this invention to provide a new and improved system and method for communicating information in a surveillance or monitoring system.

Another object is to provide a condition monitoring system wherein a person monitoring a condition or conditions is warned or indicated of a change in a condition by sounds of speech so that the person need not read and interperet a display or gage.

Another object is to provide a condition monitoring system which will permit personnel to perform other tasks than read or watch displays or meters.

Another object is to provide an automatic warning system which provides speech sounds of conditions or changes in condition sensed to indicate to monitoring personnel or personnel who will be affected by such changes in condition, the existence or approach of a hazzardous condition.

Another object is to provide an electronic sensing and warning system and method for warning of changes in the condition of a patient or patients in a hospital, by generating synthetic speech indications of patients, patient locations and their conditions.

Another object is to provide a warning system for use where hazzardous conditions may suddenly develope for warning by speech sounds of the existence or approach of such conditions.

Another object is to provide a new and improved security system employing synthetic speech for indicating security conditions to personnel monitoring such conditions.

Another object is to provide a synthetic speech generating system and a subsystem for activating same which may be modified or adjusted for monitoring a variety of different variables and generating speech indications of such conditions.

Another object is to provide a system for indicating a remote condition by means of a visual display and sounds of speech.

Another object is to provide an electronic system which is operable to indicate by speech sounds a change in a remote condition wherein such speech sounds are repeated more than once in the event that a remedial action is not taken in response thereto.

Another object is to provide a communication system wherein synthetic speech sounds are generated for communicating information by signal transmission to avoid missunderstanding sometimes resulting from voice generated speech.

With the above and such other objects in view as may hereinafter more fully appear, the invention consists of the novel constructions, combinations and arrangements of system components and methods for communicating as will be more fully described and illustrated in the accompanying drawings, but it is to be understood that changes, variations and modifications may be resorted to which fall within the scope of the invention as claimed.

The instant invention, which employs synthetically generated speech for communicating information or indicating monitorable conditions, may be employed in a number of physical arrangements depending on the variable conditions being monitored, the number of persons partaking in the monitoring operation and their locations, the mobility of such persons and the physical parameters of the system. In its simplest form, the system consists of one or more sensors of one or more conditions, a single monitor station, a communication link or links between the sensors and the monitor station and synthetic speech signal generating and control means for generating speech indications of the condition or conditions being monitored as they occur. The monitor station may be fixed as part of a console which includes data logging or recording means and one or more visual displays of the condition(s) being monitored. The information received from the sensors may be displayed, recorded and indicated by means of specific synthetic speech or certain conditions may be so indicated as they occur and/or before they occur. Electronic control and computing means may also be employed to control a synthetic speech generator to generate speech defining commands or suggestions to the person monitoring the information or affected thereby to stand by, pay attention to visual data as it is generated, take remedial action, warn others and/or perform other necessary functions.

In a more complex form of the invention, a plurality of monitoring or indicating stations may form the system, one of which may be fixed and the others portable or in any suitable combination. The fixed station may include a computer or signal processor operable to analyze signals or data transmitted thereto by short wave or wire and generate either synthetic speech signals or codes indicative of selected speech information and transmit such signals to one or more portable or satellite receivers which contain either speaker means for generating synthetic speech sounds or synthetic speech signals from their own speech synthesizers or electronic circuits capable of generating synthetic speech signals for application to their own speakers.

Figure 2:
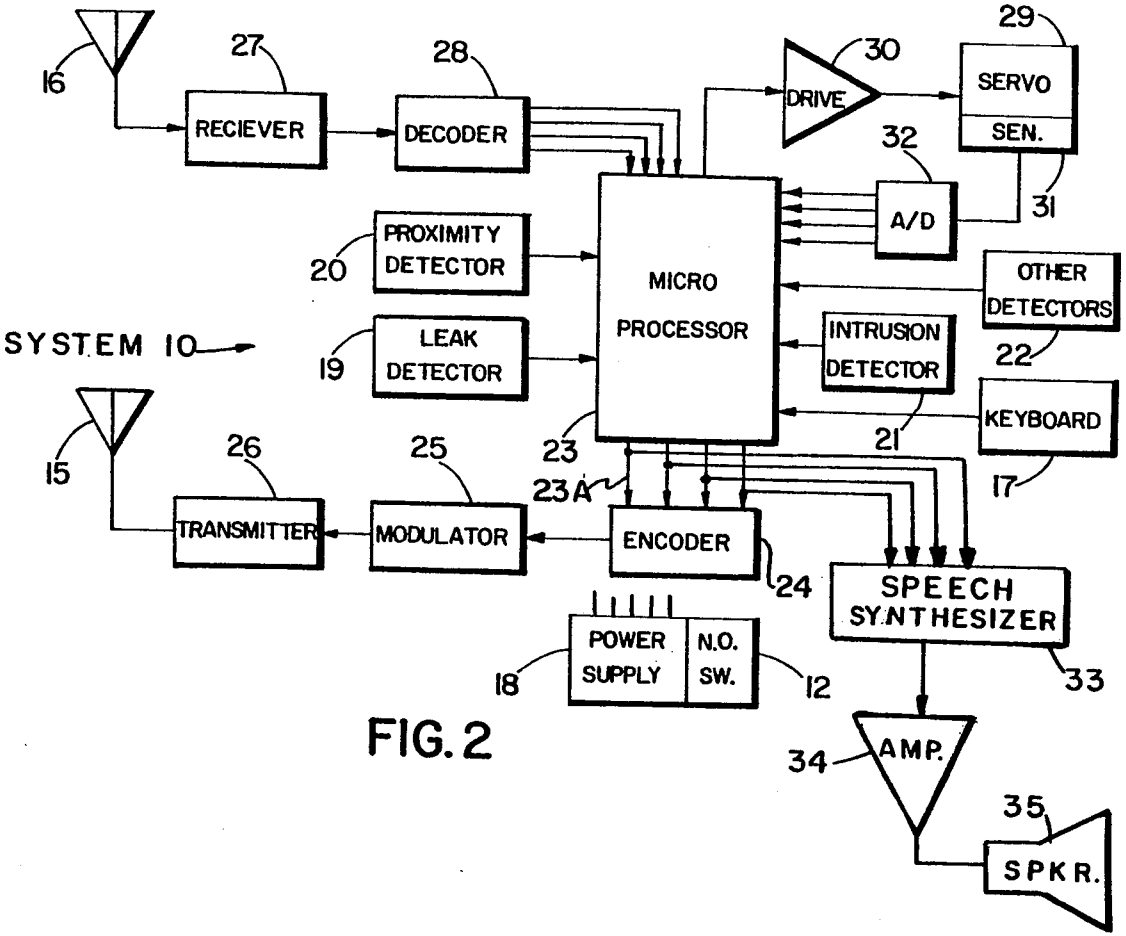
FIG. 2 is a schematic diagram of the components of FIG. 1 and remote sensors connected thereto.
Figure 1:
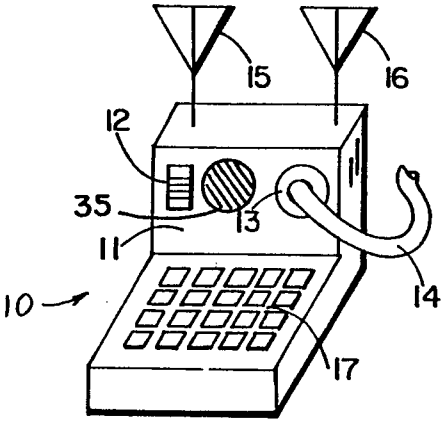
FIG. 1 is an isometric view of a subsystem component of the instant invention.

FIG. 1 illustrates an electronic console forming part of an electronic control or surveillance system 10, shown in detail in FIG. 2 and defining one form of the invention. A housing 11, made of plastic or metal, supports a manually operable on-off switch 12, a transmit antenna 15, a receive antenna 16, an entry keyboard 17 and a multiple conductor cable 14 which passes through a grommet 13 and connects to local and remote sensors which will be described, and a load speaker 35.

FIG. 2 is illustrative of the electronic construction of system 10. A power supply 18 of suitable parameters, having an on-off switch 12, is connected to the components of the system by suitable interconnects. A series of remote detectors, such as one or more leak detectors 19, proximity detectors 20, intrusion detectors 21 and, when applicable, one or more additional detectors denoted 22, which detect any desired or known variable, are each operable to generate either analog signals or digital signals on their outputs which are indicative of the value of the variable sensed, and are all connected to an electronic microprocessor 23, a portion of which is operable to digitize any signals received thereby in analog form. The microprocessor 23 is also constructed to analyze signals received thereby which are representative of abnormal conditions as indicated by the program or logic circuitry forming the analyzing circuit portion of the microprocessor. The microprocessor 23 provides digitally coded output signals which are representative of the condition or conditions detected and analysed and transmits such signals to an encoder 24 which converts the digital code to a form capable of being transmitted, such as a series of coded tone signals. The signals, thus encoded, are then input to a modulator 25 and then to a short wave transmitter 26 for subsequent application to and radiation by the transmitter antenna 15. For local monitoring, the outputs 23A of microprocessor 23 extend to a synthetic speech signal synthesizer 33, the output of which is a selected analog signal which is passed to an amplifier 34 and converted to selected words by means of speaker 35.

Short wave transmitted command signals, received by receiving antenna 16 after having been transmitted, as described hereafter, form the input to a receiver 27, which tunes and demodulates the signals so modified, which are then decoded into representative digital form by a decoder 28 which then presents the non-digital commands to the microprocessor 23. These commands may be used to control a servo-mechanism 29 or a plurality of such mechanisms, via a servo-driver 30. The response of servo-mechanism 29 to the command signals generated, is monitored by a position sensor 31 and converted thereby to an electrical signal, which is subsequently converted to digital form by analog-to-digital converter 32 and is applied to the microprocessor 23 which analyzes the data and either acts upon such data to continually adjust the servo in a feedback loop until attaining proper adjustment as defined by the received instructions or the microprocessor may transmit the new position data via the encoder 24, modulator 25, transmitter 26 and antenna 15.

Figure 3:
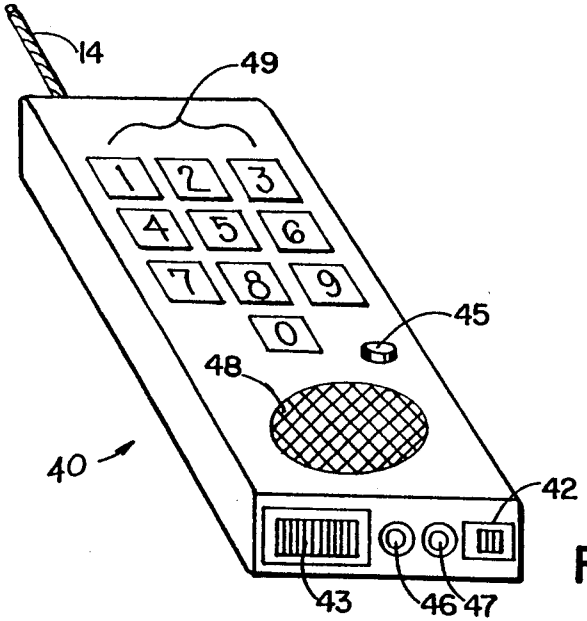
FIG. 3 is an isometric view of a modified form of the subsystem component of FIG. 1 which may also be used with the subsystem of FIG. 1 in a monitoring system and FIG. 4 is a schematic diagram of electronic components of a subsystem of the type defined by FIG. 3.

FIG. 3 illustrates a typical external physical construction of a remote system 40. A housing 41 supports an on-off switching means 42, a transmit-receiver switch 43, an antenna 44, a volume control 45, a repeat switch 46, a reset switch 47, a speaker opening 48 and a keyboard 49.

Figure 4:
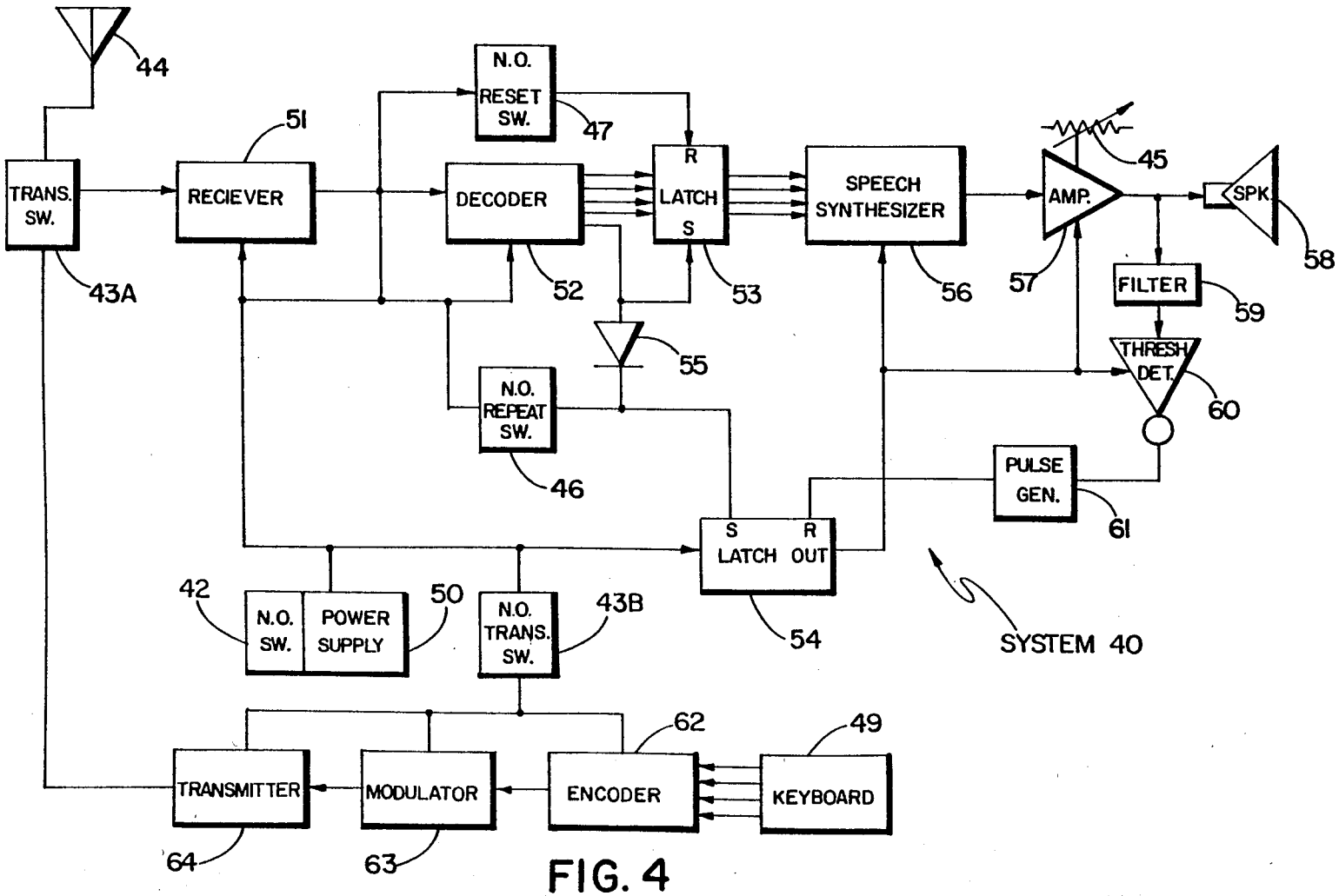

FIG. 4 illustrates the electronic construction of portable system 40. A suitable power supply 50, such as a battery, is connected to power the system by manual closure of an on-off switch 42 which is operated with proper parameters and is suitably accessible and connected. Signals transmitted by the above described transmitter 26 are picked up and converted to electrical signals by antenna 44. These signals are then transferred to a receiver 51 by means of closure of transmit switch 43A, which is normally in the receiving condition. This receiver tunes, demodulates and applies such signals to a decoder 52 for conversion to digital form and subsequent application as an input to a multiple latch circuit 53. One bit of data decoded by decoder 52 is used to set the latches or circuit 53 and via isolation diode 55, latch 54 which, when set, supplies operational power to a speech synthesizer 56, amplifier 57 and a threshhold detector 60. This bit of data indicates an incoming signal. Data input by latch 53 replicates the data input at the time latch 53 is set. This replicated output is then converted by speech synthesizer 56, which may comprise a Texas Instruments TMC 0280 microcircuit or other similar device, into electronic signals representative of a vocalization of the meaning of the data.

The representative signals are then amplified by an amplifier 57 having an attendant volume control means 45 and are audibly reproduced by a loud speaker 58.

The output of amplifier 57 is also passed through a filter 59 which converts the output to a D.C. signal which is used to trigger the inverting threshhold detector 60, which itself triggers a pulse generator 61 resetting latch 54, thereby ceasing the flow of activation current to the speech synthesizer 56, amplifier 57, filter 59 and threshhold detector 60, thus effecting a saving in battery power. Repetition of the above synthetic vocalization may be accomplished by a momentary activation of the repeat switch 46 which operates to set latch 54 and repower the speech synthesizer 56 and all subsequent circuitry. System 40 is reset by momentary activation of a reset switch 47, which transfers a reset pulse to the reset input of latches 53 clearing them of the stored data.

System 40 may also be used to remotely control or correct the conditions indicated. Transmit switch 43A is switched from the receive to the transmit position. Operational power from power supply 50 is transferred by transmit switch 43B which is normally open, to an encoder 62, modulator 63 and transmitter 64.

A digitally coded keyboard 49 is employed to permit manual generation of digital signals for input to an encoder 62, which converts the codes so generated into transmittable signals, such as a series of tones. The encoded signals are passed to a modulator 63 and are subsequently applied to a transmitter 64 for transmission through transmit switch 43A, through an antenna 44 to system 10, which codes may be used to control the servo 29 in the manner indicated above.

In a modified form of the invention, the speech synthesizing electronic circuit 56 may be connected to the code generating outputs 23A of the microprocessor 23 of FIG. 2 to generate synthetic speech analog signals which may be fed directly to the short wave transmitter 26 which transmits such synthetic speech signals in analog or digital form to a receiver or receivers forming part of portable units containing respective speakers and receive-amplifying circuits for presenting such signal information in audible synthetic speech form to a person or persons in the vicinity thereof. The fixed station defined by the console 11 may also contain, in addition to such a speech synthesizer, a speaker for converting synthetic speech signals generated thereby to audible speech for indicating to a person thereat the condition sensed or developing. In a combined system, speakers for generating sounds of synthetic speech in accordance with computer or microprocessor generated codes as described, may be provided both at the fixed or central console and satellite or portable stations which may include, in addition to a short wave receiver and amplifying circuit and a speaker, a visual warning indicator and, in another form, a short wave transmitting circuit and control for indicating to a person at the fixed station that the information received as codes or synthetic speech signals has been recognized. Further controls of the manual operating type, may also be provided at each portable or satellite unit or units for generating and effecting short wave transmission of codes which are operable to control remote devices for correcting or accounting for variable conditions which are sensed and indicated by the received codes or synthetic speech signals and/or for warning other users or subscribers to the system of the condition or conditions being sensed wherein such warning may also be effected by the remote generating of synthetic speech as described and/or by speech derived by speaking into a microphone at the portable unit. The keyboard 17 of FIG. 2 and keyboard 49 of FIG. 4 may also be manually operated to generate and effect the short wave transmission of code signals for communication between fixed and portable terminals as described and for generating synthetic speech at the fixed or portable units 11 and 40 from the other unit by properly operating the keyboard to generate suitable code or synthetic speech signals on its output and transmitting such output to the remote station as described.

The systems described herein may employ code generating sensors or circuits associated with a plurality of sensors at different locations and/or operable to sense different conditions wherein the code generated when each condition is sensed is transmitted per se or along with a sensing signal to the described computer or microprocessor and is operable to effect the generation of synthetic speech signals of speech which is indicative of the location and the condition sensed to the exclusion of other locations and sensors in the system. In other words, each of the detectors 19,20,21 and 22 as well as other detectors which may be employed in the system of FIG. 2 or one of the described modifications thereof, may include means for generating a code signal when the detector becomes activated in sensing a particular condition or activates a respective code generator when such sensor is activated for generating a code indicative of the sensor and its location which code is transmitted and employed as described to generate synthetic speech indicative of the condition sensed and its location.

I claim:

1. A communication system comprising:

a monitor station having signal transmitting and receiving means, a portable monitoring device having signal generating and transmitting means and signal receiving means, a plurality of sensors remote from said monitor station and said portable monitoring device, means associated with each sensor operable to generate a different code when the sensor senses a variable condition and means for transmitting said codes to said receiving means of said monitor station, means at said monitor station for generating coded electrical signals on the output of said receiving means defining the information received from said sensors, means at said monitor station for computer analyzing the signals generated on the output of said receiving means and generating speech signals indicative of the conditions sensed, and means for transmitting said speech signals to said receiving means of said portable device, and means at said portable device for transducing the speech signals received by said receiving means to sounds of words of speech which intelligibly indicate the conditions sensed by said sensors.

2. A communication system in accordance with claim 1 including means associated with said plurality of sensors for generating and transmitting code signals to the receiving means of said monitor station which code signals identify the sensors, said computer analyzing means including means for analyzing the code signals received by the receiver of said monitor station and generating synthetic speech signals of words of speech identifying the conditions sensed by said sensors.

3. A communication system in accordance with claim 1 including means associated with each of said sensors for generating code signals identifying the location of the sensor, and means at said monitor station for generating synthetic speech signals in response to said latter code received, which speech signals define words of speech indicative of the locations of the sensors associated with the code signals generated and transmitted to said monitor station, and means at said monitor station for transducing said speech signals to words of speech indicative of the locations of said sensors.

4. A communication system in accordance with claim 3 including code signal generating means supported by said portable device for generating different code signals under the control of a person carrying said portable device to permit said person to generate different select code signals, means for short wave transmitting said latter code signals, receiving means for said code signals and means connected to said latter receiving means responsive to the received codes for effecting a control operation associated with a condition sensed by one of said sensing means.

5. A communication system in accordance with claim 1 including a variably operable device associated with the condition sensed by one of said sensing means for varying said condition, means for controlling said variably operable device including a signal responsive means, and means associated with said portable device for generating and short wave transmitting control signals to said signal responsive means for remotely controlling the operation of said variably operable device.

6. A communication system in accordance with claim 5 wherein said variably operable device includes a servo mechanism.

* * * * *